US005364332A

United States Patent [19]

Gray, Jr.

[11] Patent Number: 5,364,332

[45] Date of Patent: Nov. 15, 1994

[54] SOFT NIP FOLDER

[75] Inventor: Gary A. Gray, Jr., Webster, N.Y.

[73] Assignee: Xerox Corporation, Stamford, Conn.

[21] Appl. No.: 84,722

[22] Filed: Jul. 1, 1993

[51] Int. Cl.[5] ..... B41F 13/60; B65H 45/14; B65H 45/20

[52] U.S. Cl. ..... 493/23; 493/25; 493/419

[58] Field of Search ..... 493/1, 2, 23, 25, 320, 493/321, 419, 420

[56] References Cited

U.S. PATENT DOCUMENTS

| | | | |
|---|---|---|---|
| 1,124,375 | 1/1915 | Wood | 493/385 |
| 1,781,768 | 11/1930 | Spiess | 493/419 |
| 2,807,463 | 9/1957 | Smith | 493/321 |
| 3,589,709 | 6/1971 | Huddersfield et al. | 270/80 |
| 3,698,705 | 10/1972 | Funk et al. | 493/420 |
| 4,092,832 | 3/1982 | Crowley | 493/23 |
| 4,484,905 | 11/1984 | Ashburner | 493/419 |
| 4,504,259 | 3/1985 | Lindenmuller | 493/23 |
| 4,508,527 | 4/1985 | Uno et al. | 493/357 |
| 4,518,380 | 5/1985 | Shimizu et al. | 493/420 |
| 4,601,695 | 7/1986 | Pazzi | 493/418 |
| 4,643,705 | 2/1987 | Bober | 493/444 |
| 4,701,155 | 10/1987 | Ott | 493/14 |
| 4,717,134 | 1/1988 | Iida et al. | 270/39 |
| 4,834,695 | 5/1989 | Boblit et al. | 493/1 |
| 4,850,945 | 7/1989 | Whittenberger | 493/14 |
| 4,900,391 | 3/1990 | Mandel et al. | 156/364 |
| 5,045,039 | 9/1991 | Bay | 493/1 |
| 5,076,556 | 12/1991 | Mandel | 270/45 |

FOREIGN PATENT DOCUMENTS

| | | | |
|---|---|---|---|
| 861110 | 9/1981 | U.S.S.R. | 493/419 |

*Primary Examiner*—William E. Terrell

[57] ABSTRACT

An improved folder includes a "soft stop" reversible roll nip. Folding is accomplished by feeding a copy sheet into a stepper/servo controlled pinch roll that is under software control. The copy sheet is measured and the reversible roll nip is cycled from full forward to full reverse velocity with controlled acceleration. The reversing of the sheet causes a buckle to be created and the sheet creased by a secondary set of rolls.

5 Claims, 2 Drawing Sheets

SOFT NIP FOLDER

BACKGROUND OF THE INVENTION

This invention relates generally to a folder for use with an electrophotographic printing machine, and more particularly concerns an improved soft stop folder apparatus.

As cut and folded web sections emerge from other press folder operations, they often are given an original or final fold by means of a blade which descends in a chopping motion when a sheet is in position under it. The blade pushes the sheet down between two nip rollers, creating a fold at that point. A knife folder requires deskewed and centered copy over the folding nip rollers or the sheet may be folded off center or crooked. Also, caution in the blade positioning relative to the nip rollers is essential or the sheet may be damaged or acquired too slowly. Also, one method of folding sheets is to move hard stops via a stepper/servo mechanism automatically under software control in response to control panel selection of paper size. This requires large amounts of hardware if one is folding a 36×48 inch and requires three fan-folds plus two cross-folds which dictates 5 fold stations with attendant hardware. Accordingly, it is highly desirable to simplify the folding of sheets without damage while at the same time improving the reliability of the folder.

The following disclosures appear relevant:

- U.S. Pat. No. 1,124,375, Patentee: Wood, Issued: Jan. 12, 1915.
- U.S. Pat. No. 4,508,527, Patentee: Uno et al., Issued: Apr. 2, 1985.
- U.S. Pat. No. 4,900,391, Patentee: Mandel et al., Issued: Feb. 13, 1990.
- U.S. Pat. No. 4,643,705, Patentee: Bober, Issued: Feb. 17, 1987.
- U.S. Pat. No. 3,589,709, Patentee: Huddersfield et al., Issued: Jun. 29, 1971.
- U.S. Pat. No. 4,518,380, Patentee: Shimizu et al., Issued: May 21, 1985.
- U.S. Pat. No. 4,701,155, Patentee: Ott et al., Issued: Oct. 20, 1987.
- U.S. Pat. No. 4,717,134, Patentee: Iida et al., Issued: Jan. 5, 1988.
- U.S. Pat. No. 4,834,695, Patentee: Boblit et al., Issued: May 30, 1989.
- U.S. Pat. No. 4,850,945, Patentee: Whittenberger, Issued: Jul. 25, 1989.
- U.S. Pat. No. 5,076,556, Patentee: Mandel, Issued: Dec. 31, 1991.

The pertinent portions of the foregoing disclosures may be briefly summarized as follows:

Wood discloses a folding and stapling device in which a folder blade drives and creases collected sheets into a receiving head and clips of a arm member.

Uno et al. discloses a method and apparatus for quantitatively dividing zig-zag folded sheets. A sheet of paper having a plurality of linear perforations is continuously transferred vertically through a roller and is folded in zig-zag form by operation of a crank mechanism.

Mandel '391 shows a sheet recirculating, folding and gluing system that folds documents, holds them at a wait station and then inserts them into another sheet which is folder and glued "on-line" to form an envelope.

Bober is directed to a knife folder that includes a blade adapted to collapse a sheet a predetermined amount in order to allow nip rollers to buckle the sheet into a pair of folding cylinders. This apparatus ensures positive paper acquisition while reducing potential for blade damage to the sheet.

Huddersfield et al. discloses a control apparatus for the measurement and folding of flat workpieces. The apparatus comprises a first detector and transmitter for detecting and measuring a dimension of a traveling workpiece and transmitting a signal to a memory. The signal in memory is used to initiate a folding operation.

Shimizu et al. discloses a paper folding device having multiple rollers for forming nips and an adjustable stop. The adjustable stop is manually adjustable to accommodate different sizes of paper.

Ott discloses a buckle chute folder for automatically folding successive sheets of paper. A photosensor senses leading edge positions fed sheets and a solenoid-operated clamp is actuated to clamp the sheets in a proper position during folding. Pulse counting is used to determine incremental paper movement through the folder.

Iida et al. discloses a sheet folding apparatus capable of folding sheets in two-fold, Z-fold, or reverse Z-fold configurations utilizing one four roll assembly with multiple entrance paths. The apparatus uses movable stoppers to accommodate different paper sizes.

Boblit et al. discloses an automatic fold-pan assembly for attachment to a sheet folding machine. The assembly includes at least one fold-controlling paper stop disposed in the assembly. The positioning of the paper stop a predetermined distance from an entrance mouth is controlled by a computer in conjunction with stepper motors.

Whittenberger discloses a gatefold apparatus comprising a sensor for sensing paper movement out of a panfold and a control means, responsive to the sensor, for controlling an actuator which is guided between third and fourth rolls to gatefold a sheet.

Mandel '556 is directed to an apparatus that places two or more folds in a sheet of paper which requires only a single fold position controlling chamber and one pair of fold producing rollers.

SUMMARY OF THE INVENTION

In accordance with the present invention, there is provided an improved sheet folder folder in which the usual multiplicity of mechanical hard stops which stop a lead edge to form a buckle which is trapped and folded by pinch rolls are replaced by software control of a "soft stop", which comprises a pinch roll that cycles from forward to reverse to form a buckle that is creased by a secondary set of rolls. This apparatus allows easy control over the position of a crease without need to move a hard stop and enables multiple folds without extra stops and rolls.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements.

DETAILED DESCRIPTION OF THE PREFERRED EMBODIMENT

Figure 1:
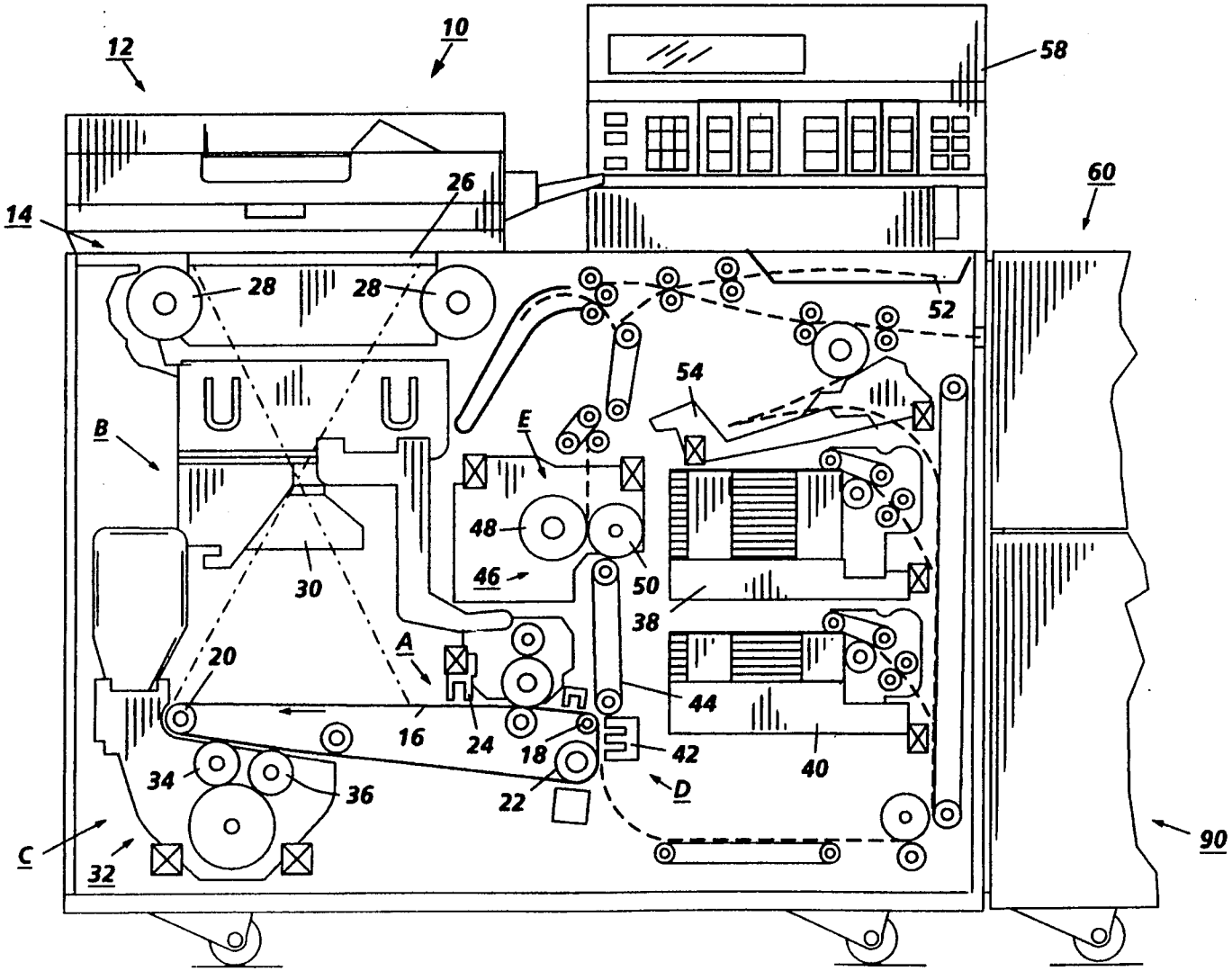
FIG. 1 is a schematic showing an electrophotographic machine feeding sheets to be folded by the improved folder of the present invention. However, it will become apparent from the following discussion that the present folder could be used to fold sheets from any machine, and is not limited to the embodiment shown herein.

Turning now to FIG. 1, printing machine 10 includes conventional controller 58 and a recirculating document handling system 12 for advancing successive original documents onto the platen of the processing module 14. Inasmuch as the art of electrophotographic printing is well known, the operation of the various processing stations employed in processing module 14 will be described briefly.

Processing module 14 employs a belt 16 having a photoconductive surface deposed on a conductive substrate. Preferably the photoconductive surface is made from a selenium alloy with the conductive substrate being preferably made from an aluminum alloy which is electrically grounded. Belt 16 advances successive portions of the photoconductive surface sequentially through the various processing stations disposed about the path of movement thereof. Belt 16 is entrained about stripping roller 18, tensioning roller 20 and drive roller 22. Drive roller 22 is coupled to a suitable motor so as to rotate and advance belt 16.

Initially, a portion of belt 16 passes through charging station A. At charging station A, a corona generating device 24 charges the photoconductive surface of belt 16 to a relatively high, substantially uniform potential.

After the photoconductive surface of belt 16 is charged, the charged portion thereof is advanced through exposure station B. At exposure station B, a original document is advanced by the recirculating document handling system 12 to a transparent platen 26. Lamps 28 flash light rays onto the original document. The light rays reflected from the original document are transmitted through lens 30 forming a light image thereof. Lens 30 focuses the light image onto the charged portion of the photoconductive surface to selectively dissipate the charge thereon. This records a electrostatic image on the photoconductive surface of belt 16 which corresponds to the informational areas contained within the original document.

Thereafter, belt 16 advances the electrostatic latent image recorded on the photoconductive surface to development station C. At development station C a magnetic brush development system, indicated generally by the reference numeral 32, advances developer material into contact with the latent image. Preferably, magnetic brush development system 32 includes two magnetic brush developer rollers 34 and 36. Each roller advances developer material into contact with the latent image. These rollers form a brush of carrier granules and toner particles extending outwardly therefrom. The latent image attracts the toner particles from the carrier granules forming a toner powder image on the photoconductive surface of belt 16.

After the electrostatic latent image is developed, belt 16 advances the toner powder image to transfer station D. A sheet of support material is advanced to transfer station D from a copy sheet stack supporting apparatus 38 or 40. Transfer station D includes a corona generating device 42 which sprays ions onto the backside of the copy sheet. This attracts the toner powder image from the photoconductive surface to the copy sheet. After transfer, the copy sheet moves onto conveyor 44 which advances the sheet to fusing station E.

Fusing station E includes a fuser assembly, indicated generally by the reference numeral 46, which permanently affixes the transferred powder image to the copy sheet. Preferably, fuser assembly 46 comprises a heated fuser roller 48 and a back-up roller 50. The copy sheet passes between the fuser roller and back-up roller with the toner powder image contacting the fuser roller. In this manner, the toner powder image is permanently affixed to the copy sheet. After fusing, the copy sheet is either advanced to output tray 52, re turned to duplex tray 54 for subsequent recycling so as to enable a toner powder image to be transferred to the other side thereof, or if folding is required, directed into folder 60 that is partially supported by castor mounted support 90. The detailed structure of "soft stop" folder 60 will be described hereinafter with reference to FIGS. 2–4.

Figure 2:
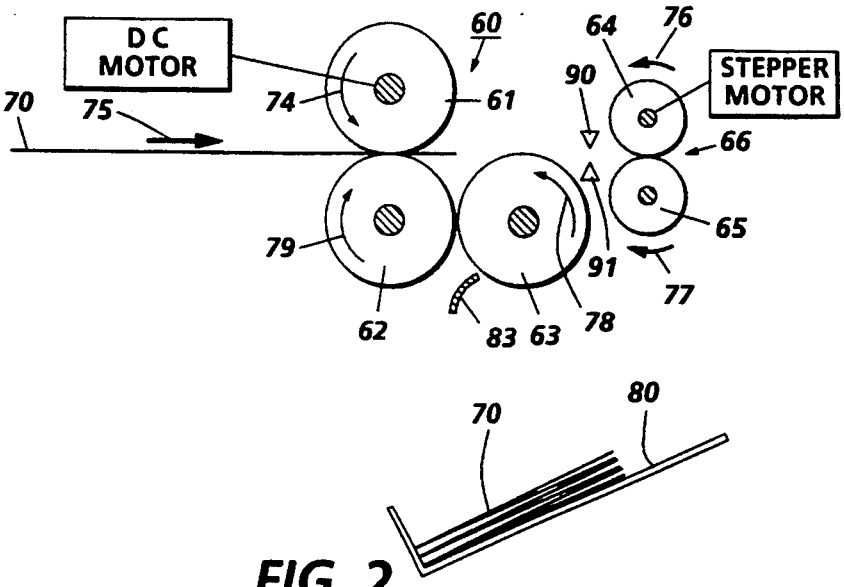
FIG. 2 is a fragmentary elevational side view of the folder apparatus used in the electrophotographic machine of FIG. 1 and showing a sheet being driven by transport rolls.

Referring now to FIG. 2, there is shown a fragmentary elevational view illustrating "soft stop" folder 60 in greater detail. As depicted thereat, reversible folder 60 includes a "soft stop" reversible nip 66 comprising drive roll 64 which is controlled by a reversible stepper motor and operates initially in the direction of arrow 76 and idler roll 65 that is initially driven by drive roll 64 in the direction of arrow 77. Drive roll 61 and idler roll 62 form a transport nip that receives copy sheets 70 from copier/printer 10 and drives them individually toward reversible drive nip 66. An idler roll 63 is in contact with idler roll 62 that is included in order to form a nip therebetween and crease any copy sheet forced into the nip. Baffle 83 is positioned to deflect each creased copy sheet into catch tray 80 for storage and subsequent removal.

Figure 3:
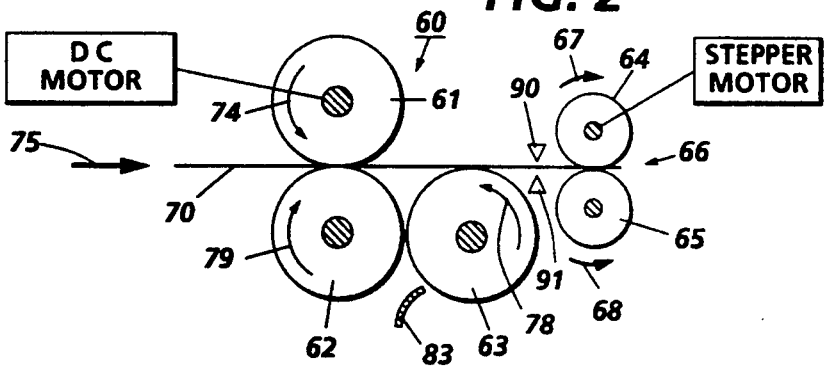
FIG. 3 is a fragmentary elevational side view of the folder apparatus of FIG. 2 showing the sheet being captured by a reversible "soft stop" nip.
Figure 4:
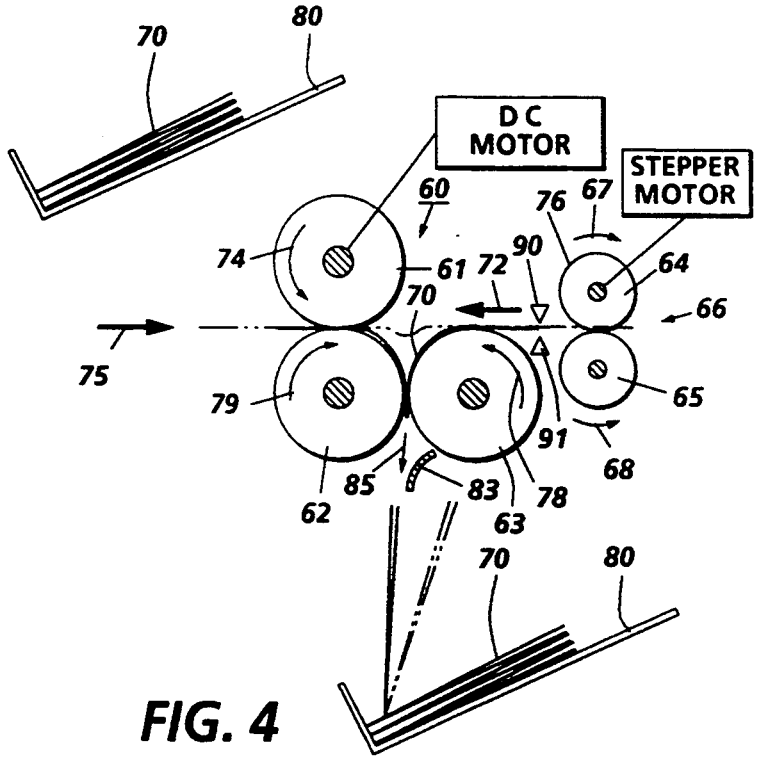
FIG. 4 is a fragmentary elevational side view of the folder apparatus of FIG. 2 showing sheets having been folded by reversing of the rolls of the "soft stop" nip.

As shown in FIG. 3, copy sheet 70 has been transported by DC motor driven drive roll 61 and idler roll 62 in the direction of arrow 75 as they rotate counter clockwise and clockwise in the direction of arrows 74 and 79, respectively. Copy sheet 70 is shown at the instant it is captured by stepper/servo controlled "soft stop" pinch roll nip 66 and after it has passed lead edge sensors 90 and 91 which are used in conjunction with the stepper motor to keep track of how much of copy sheet 70 has passed through nip 66 so that the reversible nip can be reversed at the proper time to enable creasing of the sheet in the predetermined location. Under software control of conventional controller 58, for example, in response to control panel selection of copy sheet size, the copy sheet is measured for a stopping point by the stepper motor and the "soft stop" of nip 66 is cycled from full forward in the direction of arrows 76, 77 of FIG. 2, to full reverse velocity with controlled acceleration of rolls 64 and 65 now rotating in the direction of arrows 67 and 68 of FIG. 3. In FIG. 4, the phantom line shows a buckle being forced into copy sheet 70 as the result of reversible roll nip 66 slowing down, stopping and then rotating against copy sheet 70 in the counter clockwise direction of arrows 67 and 68. Once the buckle is created, the sheet is creased by rollers 62 and 63 and driven against baffle 83 downward in the direction of arrow 85 into catch tray 80. Since the copy sheet could be controlled completely as to velocity and direction, reversible nip 66 can also be used for recycling the sheet in order to use the same hardware for multiple folds. That is, the DC motor that drives drive roll 61 could be replaced with a reversible stepper motor and reversed after a first crease has been placed in a sheet to draw the sheet out of the nip between rolls 62 and 63. After the sheet has been forwarded by drive roll 61 a predetermined amount, nip 66 would be reversed again to place a crease in the sheet in a different location. If one wanted to crease the sheet in the opposite direction a creasing nip operating the same as the formed between rolls 62 and 63 could be placed above roll 61. Alternatively, a closed loop could be placed below rolls 62 and 63 that would direct the sheet back into the nip between rolls 61 and 62. This nip would transport the sheet back into nip 66 which would reversed the sheet for creasing in another location and folding before the sheet drops into catch tray 70. Also, it should be understood that "soft stop" nip 66 could be used in any folding environment where mechanically controlled hard stops are now being used without the attendant hardware of such hard stop systems. For example, the accomplishments of the movable hard stops used in the folding apparatus of U.S. Pat. No. 4,900,391 could easily be replaced by the reversible drive rolls of the present invention at less cost.

It should now be apparent that a improved copy sheet folding assembly has been disclosed that includes a variable stop which can be moved by a stepper/servo mechanism to adapt to different fold patterns or different copy sheet sizes. More specifically, a folder apparatus has been disclosed that comprises a variable "soft stop" that includes a stepper/servo controlled pinch roll. Under software control, a copy sheet is measured and the servo-controlled stop cycles from full forward to full reverse velocity with controlled acceleration to stop the fed sheet in a predetermined location. A secondary set of rollers is used to form a buckle, crease the sheet and drive the now creased sheet into a catch tray.

What is claimed is:

1. A folder assembly, comprising:

first nip means positioned to drive a sheet in a predetermined plane including a first idler roll and a drive roll in contact with said first idler roll and adapted to initially accept a sheet from a source and transport it in a first direction in said predetermined plane;

second nip means including said first idler roll and a second idler roll positioned adjacent to and in contact with said first idler roll, said drive roll being adapted to drive both said first and second idler rolls so as to transport the sheet in said first direction in said predetermined plane before folding of the sheet takes place and in a second direction orthogonal to said predetermined plane when folding of the sheet takes place;

third nip means positioned in substantially the same plane as said first nip means and adapted to receive the sheet driven thereinto in said predetermined direction and predetermined plane by said first nip means; and control means for reversibly driving said third nip means such that the sheet driven into said third nip means by said first nip means is initially driven in said first direction and after a predetermined period of time is driven in a reverse direction, and wherein the driving of the sheet in said reverse direction against the driving of the sheet by said first nip means causes a buckle to form in the sheet with said buckle being captured by said second nip means and forming a crease in the sheet.

2. The folder assembly of claim 1, wherein said third nip means includes means connected thereto for adjusting said folder assembly to accommodate a wide variety of sheet sizes.

3. The folder assembly of claim 2, wherein said means connected to said third nip means is a stepper motor controlled by said control means.

4. A folder adapted to fold sheets exiting a output station, comprising:

nip means for driving the sheets in a first direction, said nip means including a first idler roll and a drive roll in contact with said first idler roll;

reversible nip means for receiving the sheets individually from said nip means;

control means for measuring the size of the sheet and controlling rotation of said reversible nip means in accordance with the measured size of the sheet such that said reversible nip means is rotated in said first direction for a predetermined time and then reversed in rotation in order to drive the sheet in opposition to the direction the sheet is being driven by said nip means causing a buckle to be formed in the sheet; and creasing nip means including said first idler roll and a second idler roll positioned adjacent to and in contact with said first idler roll and adapted to accept the buckle formed in the sheet by said nip means and said reversible nip means and form a crease in the sheet.

5. In a printing apparatus adapted to print page image information onto copy sheets, the improvement in the printing apparatus of a folder assembly adapted to fold the copy sheets in a predetermined location, comprising:

first nip means adapted to initially accept the copy sheets and drive them in a first direction and in a predetermined plane, said nip means including a first idler roll and a drive roll in contact with said first idler roll;

second nip means including said first idler roll and a second idler roll positioned adjacent to and in contact with said first idler roll, said drive roll being adapted to drive both said first and second idler rolls so as to transport the copy sheets in said first direction in said predetermined plane before folding of the sheet takes place and in a second direction orthogonal to said predetermined plane into said second nip means when folding of the sheet takes place;

reversible driven third nip means positioned in the same plane of and adapted to accept copy sheets from said first nip means; and control means for reversibly driving said third nip means such that a sheet driven into said third nip means by said first nip means is initially driven in said first direction and after a predetermined period is driven in a reverse direction, and wherein the driving of the sheet in said reverse direction against the driving of the sheet by said first nip means causes a buckle to form in the sheet with the buckle being captured by said second nip means and forming a crease in the sheet.

* * * * *